United States Patent [19]

Raevich et al.

[11] 4,162,620

[45] Jul. 31, 1979

[54] CIRCUIT-KNIT CLOSED END TUBULAR ARTICLE

[76] Inventors: Vladimir K. Raevich, Kutuzovsky prospekt, 9, kv. 188; Evgeny I. Petrov, ulitsa Beloveshskaya, 91, kv. 77; Elena N. Kolesnikova, Meierovsky proezd, 1/1, korpus 2, kv. 44; Alexandr K. Saxon, Sirenevy bulvar, 69, korpus 4, kv. 17, all of Moscow, U.S.S.R.

[21] Appl. No.: 876,241

[22] Filed: Feb. 9, 1978

Related U.S. Application Data

[63] Continuation of Ser. No. 639,430, Dec. 10, 1975, abandoned, which is a continuation of Ser. No. 428,858, Dec. 27, 1973, abandoned, which is a continuation of Ser. No. 269,187, Jul. 5, 1972, abandoned.

[30] Foreign Application Priority Data

Jul. 6, 1971 [SU] U.S.S.R. ..... 1671923
Jul. 6, 1971 [SU] U.S.S.R. ..... 1671924

[51] Int. Cl.[2] ..... D04B 9/56
[52] U.S. Cl. ..... 66/187; 66/9 R
[58] Field of Search ..... 66/9 R, 170, 171, 172 R, 66/187, 140 R, 140 S, 125 R, 172 E, 185

[56] References Cited

U.S. PATENT DOCUMENTS

| | | | |
|---|---|---|---|
| 249,283 | 11/1881 | Winterbottom | 66/187 |
| 388,678 | 8/1888 | Henshall | 66/187 |
| 1,114,298 | 10/1914 | Scott | 66/187 X |
| 1,270,083 | 6/1918 | Williams | 66/187 |
| 1,270,084 | 6/1918 | Williams | 66/187 |
| 2,299,300 | 10/1942 | Bjornson | 66/170 |
| 2,740,279 | 4/1956 | Getaz | 66/187 |
| 2,787,899 | 4/1957 | Getaz | 66/172 E |
| 2,903,872 | 9/1959 | Ledwell | 66/187 |
| 2,996,903 | 8/1961 | Levin | 66/125 R X |
| 3,283,544 | 11/1966 | Kent | 66/140 R |
| 3,324,686 | 6/1967 | Rosenstein | 66/187 |
| 3,453,843 | 7/1969 | Knohl et al. | 66/185 |
| 3,735,608 | 5/1973 | Billi | 66/140 R X |
| 3,776,000 | 12/1973 | Gariboldi | 66/9 R |
| 3,800,559 | 4/1974 | Fecker | 66/9 R |

*Primary Examiner*—Werner H. Schroeder
*Assistant Examiner*—Andrew M. Falik
*Attorney, Agent, or Firm*—Holman & Stern

[57] ABSTRACT

In a circular-knit, closed end tubular article, for example, a stocking or a sock, the opposite-lying loops of the linking course at the closing end are successively embraced by a linking thread and are drawn thereby together until their complete closure is aligned, thus forming a linear seam, the end of such articles being closed by laying of the linking thread in selected needles which are alternately operated on the opposite sides of a cylinder; as the thread is being pulled out, it brings together the opposite-lying loops of the linking course until their complete closure is aligned to form the linear seam which is scarcely visible on the article and its appearance resembles a looping seam.

4 Claims, 44 Drawing Figures

CIRCUIT-KNIT CLOSED END TUBULAR ARTICLE

This is a continuation of application Ser. No. 639,430, filed Dec. 10, 1975 which in turn is continuation Ser. No. 428,858, filed Dec. 27, 1973 which is continuation Ser. No. 269,187, filed July 5, 1972 which are now abandoned.

BACKGROUND OF THE INVENTION

The present invention relates to knitting processes, and more specifically to circular-knit closed-end articles, and methods for closing the ends of such articles.

Known in the art is a tubular article, for example a circular-knit closed-end stocking, and a method for its manufacture, wherein a toe closing thread is knitted into the tubular mesh in the vicinity of the toe-side edge. The closing thread is laid in selected needles of the cylinder and serves to constrict the end of the stocking to be closed (see British Pat. No. 1195668).

The closing thread passes at least once around the periphery of the mesh, with the closing thread being then pulled taut relatively to the mesh, so that the mesh is constricted into a knot at its full closure. The end of the drawn out thread is to be secured against withdrawal.

The separate thread can be pulled out by its end, or by the floating thread sections between the loops, which are gripped by special clamps and drawn out.

Also known is a tubular aritcle, for example, a circular-knit closed-end stocking, and a method for closing its end, as proposed by the Italian firm "Moncenisio", see French Pat. No. 2,017,406 published May 12, 1972 and Italian Pat. No. 891,815 patented Oct. 5, 1971. According to this method, the ground thread of the first course at the end to be closed is pulled out, thus tightening the tube of the sock and making a closed end in the form of a knot. The pulled out thread is not knitted or worked in, but remains free-ended inside the sock.

In the described tubular articles, the toe is closed by tightening their end into a knot and creasing the work due to the abrupt transition from the tightened end to knitting the full diameter of the article. The thus formed creases spoil the appearnce of the article and are inconvenient when the article is worn. Such methods of closing the toe have a limited field of application, and for the given reasons cannot be used for children's wear.

OBJECTS AND SUMMARY OF THE INVENTION

It is an object of the present invention to provide a closed-end article which will have a linear seam.

Another object of the present invention is to provide a cosed-end article, in the linear seam of which the loops of the linking course will be flat-butted in a line.

A further object of the present invention is to provide a closed-end article whose linear seam will in its properties, resemble a looping seam.

A still further object of the present invention is to devise a method of closing the end of a circular-knit tubular article, which will be simple to realize and will not require any complication or major changes in the design of the circular knitting machine.

With these and other objects in view, in a circular-knit closed-end tubular article, in which the loops of the linking course at the end to be closed are drawn together by a linking thread laid thereinto, according to the invention, the opposite-lying loops of the linking course are alternately connected together by the linking thread and are constricted thereby until their complete butt-linking is aligned, so as to form a linear seam.

Since the opposite-lying loops of the linking course are brought together until their complete butt-closure is aligned, the formed linear seam has no creases, causing substantially no thickening of the article along the linking line, and in appearance resembles a looping seam. This allows placing of the seam on any kind of hosiery and other closed-end tubular articles manufactured in circular knitting machines.

The opposite-lying loops of the linking course can be located in the linear seam in a staggered way. Such a seam is possible when connecting the loop by one linking thread, thus enabling the finest seam to be produced, which is necessary for some special types of articles.

Advantageously, employed as the linking thread can be a high-elasticity rubber-like yarn which, in the linear seam stretches along a straight line. The thread may be a runner core covered type of a spandex thread. The elasticity of this yarn permits excluding or significantly reducing the process of its pulling out to bring together the loops of the linking course, as well as obviating the operation of seaming its ends into the article.

Employed as the linking thread can be the knitting yarn of the articles which has a zigzag disposition in the linear seam and makes it possible to obtain a uniform seam almost invisible in the article.

In the method to close the end of a circular-knit article, residing in that in selected cylinder needles, in which the loops of the linking course are produced, there is liad a linking thread to be then pulled out so as to join closely the loops of the linking course, according to the present invention, the linking thread is laid in selected needles alternately operated on the opposite sides of the cylinder by known apparatus for example of the type described in U.S. Pat. No. 3,735,608, issued May 29, 1973 equivalent to French Pat. No. 2,078,373 published Nov. 5, 1971, so that the linking thread is laid in a zigzag way to form loops that alternately pass about the needles on theopposite sides of the cylinder, and in the process of pulling out said thread, also by well known apparatus for example of the type disclosed in the above French Pat. No. 2,017,406; the latter brings together the opposite site-lying loops of the linking course until their couplete butt-closure is aligned, with a linear seam being thus formed.

When the linking thread is laid in selected needles or a cylinder performing rotation, this thread, laid in a zigzag way in the form of alternating open and closed loops, and when the thread passes through selected needles of a cylinder performing reciprocal rotation, it is laid in a zigzag pattern in the form of open loops.

The possiblity to realize the method, as well as to knit the end of the article with circular and reciprocal rotation of the cylinder, permits forming the seam at the end of the mesh, or shifting it to the tube, say, to the sole zone of a stocking.

The method of closing the end of a tubular article by a linking thread in no way limits the methods of manufacturing the articles themselves, and can be realized both on articles knitted from the closing end, and on those knitted from the open end.

The linear seam produced on the article resembles in appearance a looping seam and is scarcely visible in the article, since it is formed by bringing together the loops of the linking course into a line, after their constriction, by a linking thread which is laid in selected needles alternately operated on the opposite sides of the cylinder.

The invention is further explained by a description of particular illustrative embodiments thereof with references to the accompanying drawings, wherein:

DETAILED DESCRIPTION OF THE INVENTION

The method to close the end of circular-knit tubular articles and the seam thus formed are explained by an example of a stocking knit from the toe, or alternatively, from the welt.

Figure 1A:
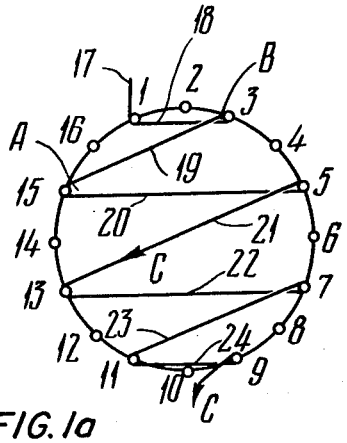
FIG. 1*a* diagrammatically illustrates the pattern of laying one linking thread in selected needles of a cylinder executing rotation, FIG. 1*b* diagrammatically illustrates the pattern of laying the linking thread in selected needles of a cylinder executing rotation when employing one linking thread in mutually opposite directions, FIG. 1*c* diagrammatically illustrates the pattern of laying two linking threads in selected needles of a cylinder executing rotation, FIG. 1*d* diagrammatically illustrates the pattern of laying two linking threads in mutually opposite directions in selected needles of a cylinder executing rotation, FIG. 2*a* diagrammatically shows the pattern of laying one linking thread in selected needles of a cylinder executing reciprocal rotation with open loops formed on all the needles and the gripping of a connecting thread where, in FIG. 1*a*, the open and closed loops are formed on needles 3, 5, 7 and 9, FIG. 2*b* diagrammatically shows the pattern of laying one linking thread in mutually opposite directions in selected needles of a cylinder executing reciprocal rotation.
Figure 1B:
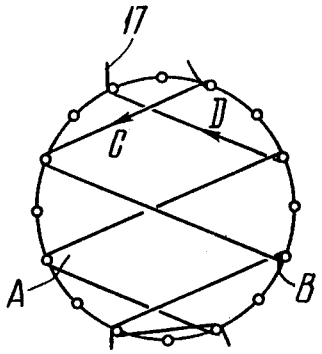

When the stocking is knit from the closing end, i.e., the toe, a linking thread 17 is first laid in selected needles 1–16 (FIG. 1*a*) of the cylinder of the circular knitting machine, on which the loops of the linking course will be formed.

Figure 7A:
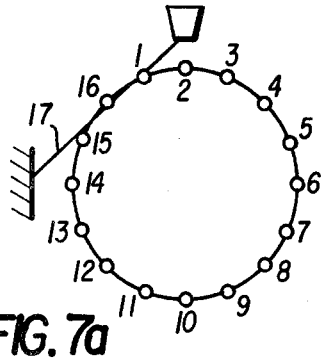
Figure 7B:
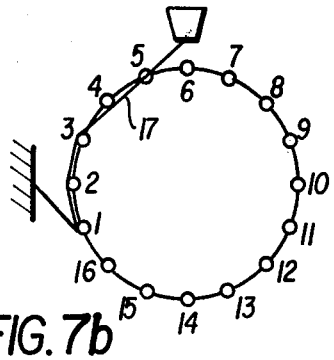
Figure 7C:
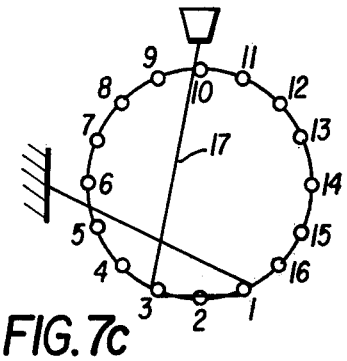
Figure 7D:
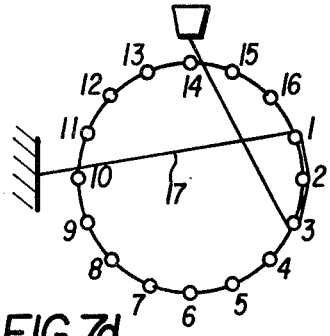
Figure 7E:
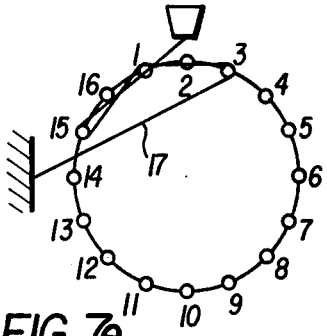
Figure 7F:
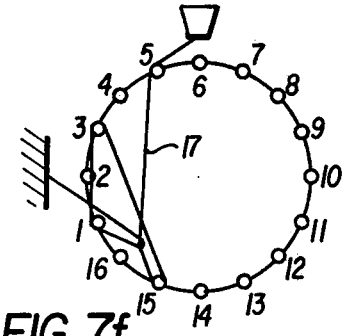
Figure 7G:
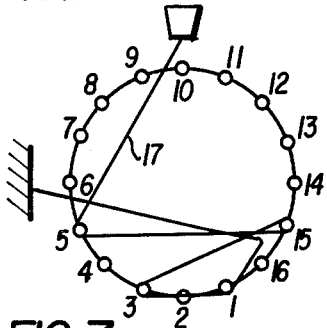
Figure 7H:
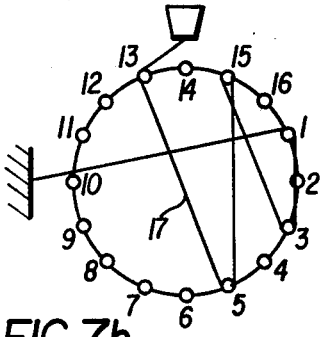
Figure 7I:
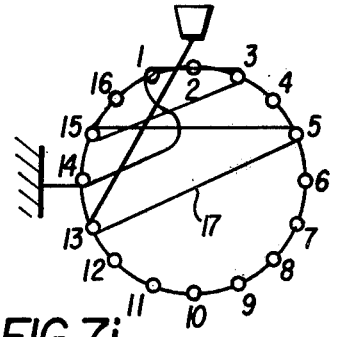
Figure 7J:
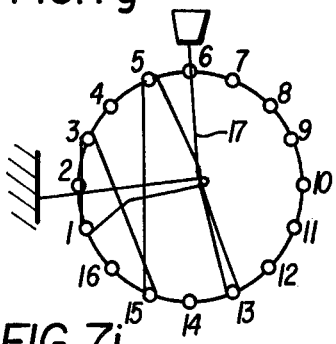
Figure 7K:
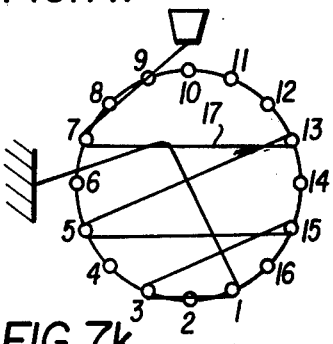
Figure 7L:
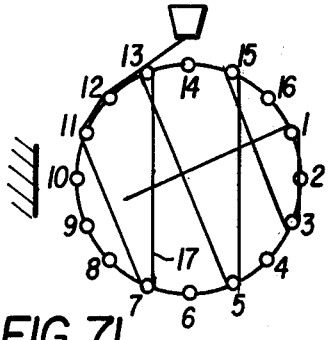
Figure 7M:
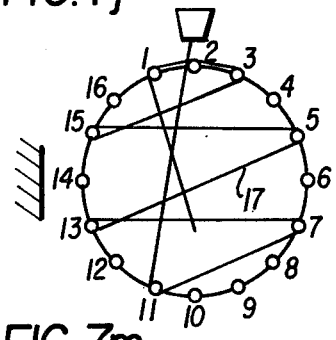
Figure 7N:
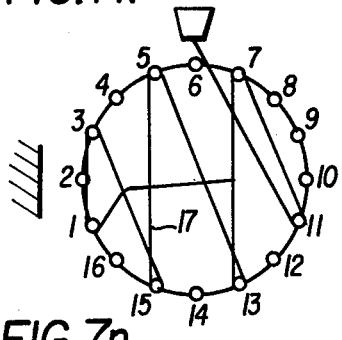
Figure 7O:
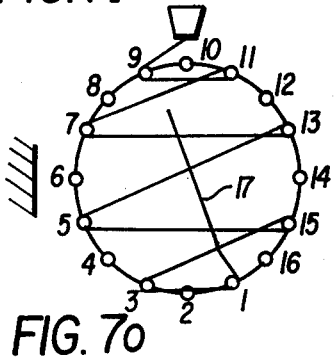
Figure 8A:
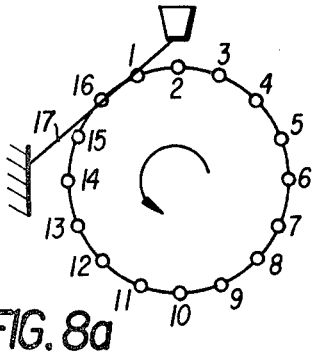
Figure 8B:
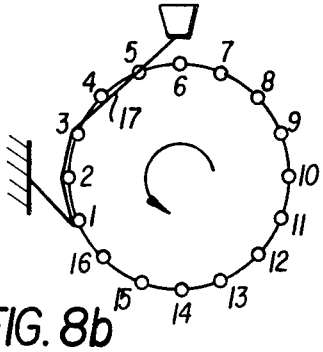
Figure 8C:
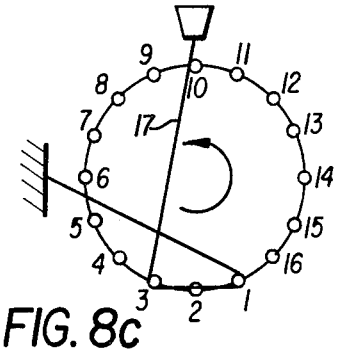
Figure 8D:
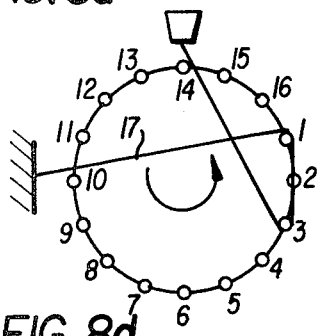
Figure 8E:
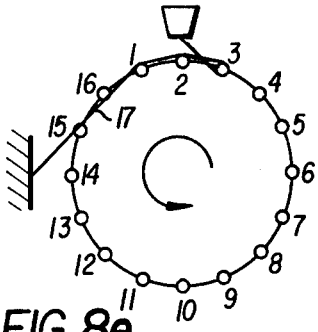
Figure 8F:
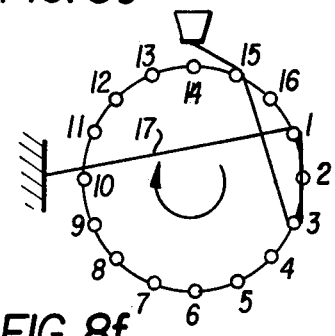
Figure 8G:
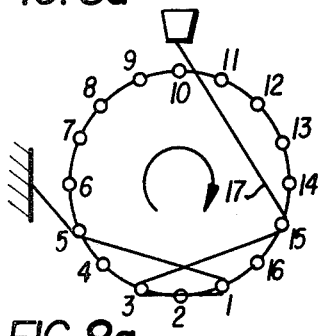
Figure 8H:
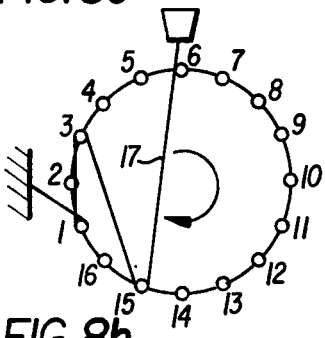
Figure 8I:
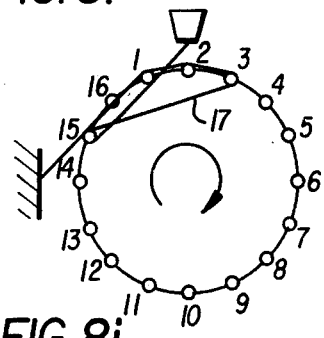
Figure 8J:
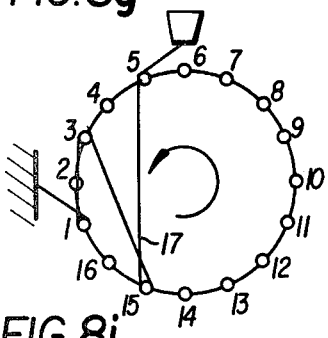
Figure 8K:
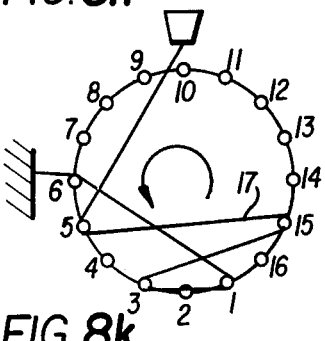
Figure 8L:
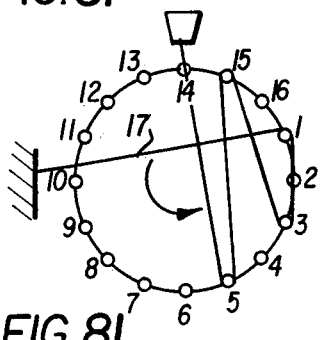
Figure 8M:
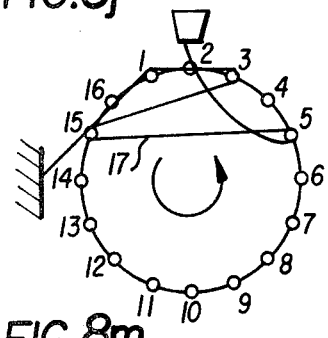
Figure 8N:
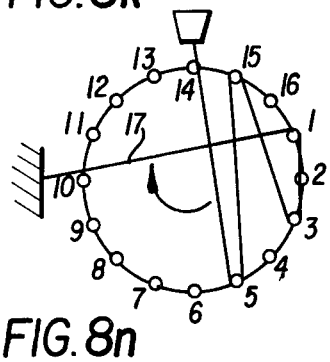
Figure 8O:
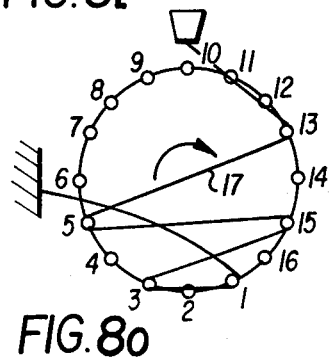

FIGS. 7*a*, 7*b*, 7*c*, 7*d*, and 7*e* illustrate the laying of the linking thread on the cylinder needles 1, 3, 15 with the formation of a closed loop on needle 15. FIGS. 7*f*, 7*g*, 7*h*, 7*i*, illustrate thread laying on needles 5, 13 on the second revolution of the cylinder. FIGS. 7*j*, 7*k*, 7*l*, 7*m*, show a linking thread being lain on needles 7 and 11 and the formation of a closed loop on needle 13. FIGS. 7*a* to 7*o*, show the process of laying a linking thread on needle 9 with the formation of a closed loop on needle 11. FIGS. 8*a* to 8*o* illustrate the consecutive laying of the linking thread during reverse rotation of the cylinder and formation of open loops on the cylinder needles.

The number of needles wherein the linking thread 17 is to be laid is unlimited, and the greater the number of selected needles, the more needles will receive the linking thread 17, and the longer will be the seam on the article which, in its appearance, will approximate a looping seam.

Figure 1C:
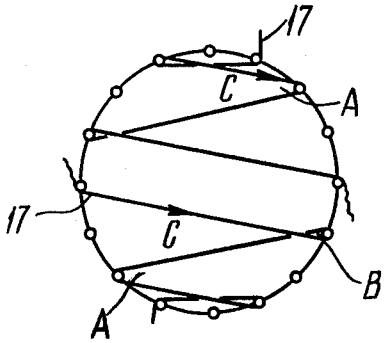
Figure 1D:
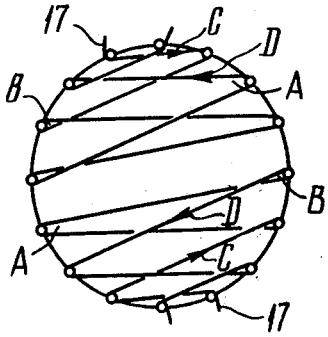

To reduce the time for drawing together the loops of the linking course, the number of linking threads 17 can be increased. Thus, shown in FIG. 1*c* are two threads 17 laid in one direction as indicated at C with, FIG. 1*d* showing two threads 17 liad in forward and reverse directions as pointed out at C and D, respectively.

Figure 2B:
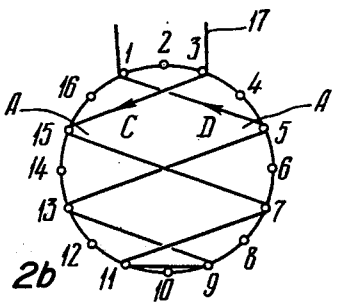
Figure 2A:
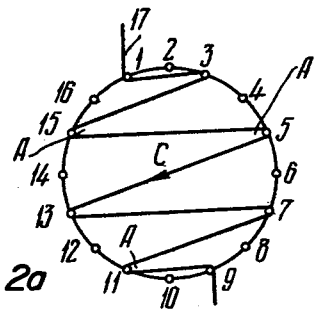

The linking thread 17 can be laid in the selected needles 1,3; 15,5; 13,7; 11,9 of the cylinder performing reciprocal rotation, wherein thread 17 is being laid in a manner as as circular rotation of a cylinder with the formation of only open loops A (FIG. 2*a*). The linking thread shown, for example in FIG. 2*a* can be laid by selecting one needle and laying therein the thread during each rotation of the cylinder.

If the stocking is to be knit from the closing end, after the linking thread 17 is laid, the stocking is begun to be knitted in the ordinary way, with an anti-run selvage being formed by the loops of the linking course.

Then, after knitting several courses of loops with circular rotation of the cylinder, the toe is knitted with a circular or reciprocal rotation of the cylinder.

The rest of the stocking is knit in the ordinary way.

Figure 3A:
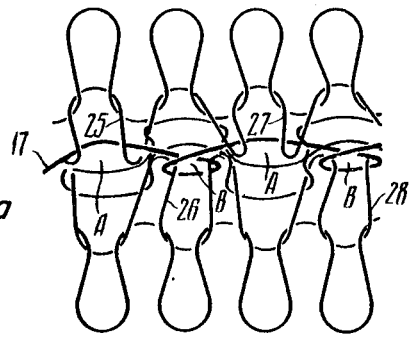
FIG. 3*a* is a diagrammatic view of a theoretical lay-out of the loops of the linking course in the linear seam on the tubular article in the case of rotation of the cylinder.

As the article is being knit, the linking thread 17 (FIG. 1*a*) is pulled out by suitable means (not illustrated), and since thread 17 was laid in a zigzag way forming alternating loops A and B that successively embrace the needles on the opposite sides of the cylinder, this thread, as it is being pulled out, brings together the opposite-lying loops 25–28 (FIG. 3*a*) of the linking course that were produced on the selected needles, until their complete butt-closure is aligned, thus forming a linear seam.

The closed loops B of thread 17 embrace loops 26, 28 located on one side of the linking course, while the open loops A of thread 17 embrace loops 25, 27 located on the opposite side of the linking course, with the linking thread thus alternately passing about the opposite-lying loops of the course.

When linking thread 17 is used, the opposite-lying loops 25–28 of the linking course in the linear seam are disposed in a staggered order.

Figure 3B:
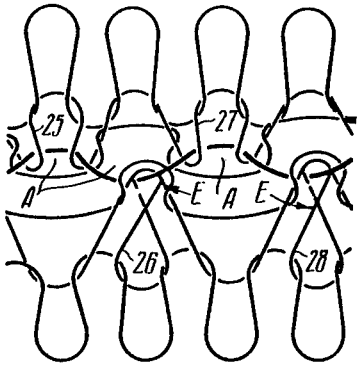
FIG. 3*b* is a view similar to FIG. 3*a* of an actual layout.

As the thread 17 is being pulled out, its closed loops B turn over to become open loops A (FIG. 3*b*), at the same time turning loops 26, 28 of the linking course into position E.

Figure 3C:
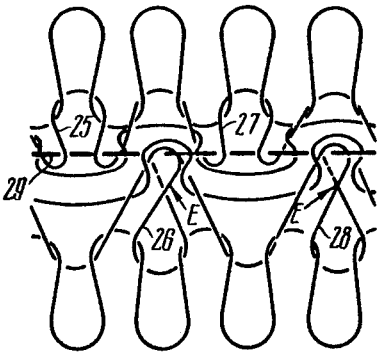
FIG. 3*c* is a view similar to FIG. 3*a* of a lay-out of a linking thread of high-elasticity rubber-like yarn.

Employed as the linking thread 17 can be a high-elasticity rubber-like yarn, for example, a rubber-core or spandex yarn previously mentioned. In the process of pulling such yarn in the linear seam, it stretches along a straight line 29 (FIG. 3*c*).

The ends of the linking thread 17 are fixed by one of conventional methods, say, by welding, or by knitting after its pulling and complete connection of the loops.

With respect to the fixing of the ends of the linking thread, it is pointed out that the beginning of the thread is fixed, for instance, by knitting it right when the thread is laid, or as has been above-described.

Figure 4:
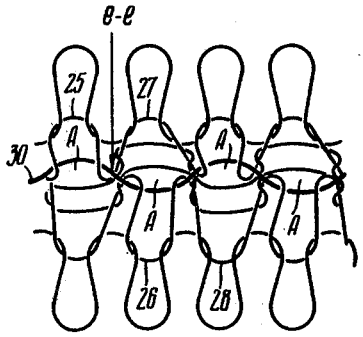
FIG. 4 is a diagrammatic view showing the lay-out of the loops of the linking course in the linear seam on the tubular article in the case of reciprocal rotation of the cylinder.

When using yarn 30 (FIG. 4) of the knit article itself as the linking thread 17, and laying it with both circular or reciprocal rotation of the cylinder, it zigzags in the linear seam in the form of a wavy line e-e. Shown in FIG. 4 shows a seam made by the knitting yarn 30 laid with reciprocal rotation of the cylinder in the form of open loops A alternately embracing the opposite-lying loops 25–28 of the linking course.

Figure 5A:
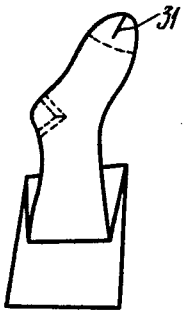
FIGS. 5*a* and 5*b* illustrate the lay-out of the seam on the articles, FIG. 6*a* diagrammatically shows the theoretical lay-out of the loops of the linking course when laying therein one linking thread in the form of tuck stitches, in the case of reciprocal rotation of the cylinder, with the article being knitted from its open end.
Figure 5B:
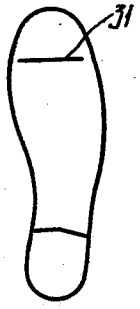

If the toe of the stocking is knit with a circular rotation of the cylinder, the linking seam 31 on the stocking is disposed as is shown in FIG. 5*a*. When necessary, seam 31 can be shifted to the sole of the stocking, which is done by knitting the toe with a reciprocal rotation of the cylinder, and the linear seam 31 is then located on the sole (FIG. 5*b*).

The described method of closing the end of a circular-knit tubular article can be realized on completing the ordinary knitting process on the article, say, a stocking knit from the welt.

Figure 6A:
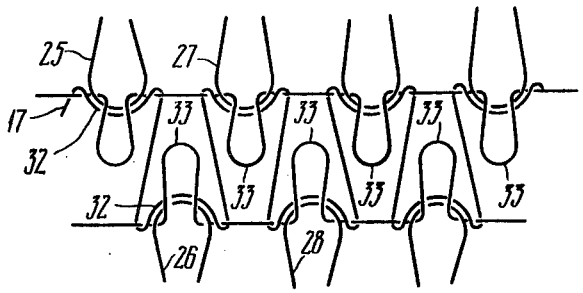
FIG. 6*b* is a view similar to FIG. 6*a* with the use of one or two linking threads in mutually opposite directions, and FIGS. 7 (*a–o*) and FIGS. 8 (*a–o*) are diagrammatic views, illustrating the linking thread laying process with the formation of closed and open loops, upon rotation of the cylinder and open loops upon a reciprocal rotation of the cylinder.
Figure 6B:
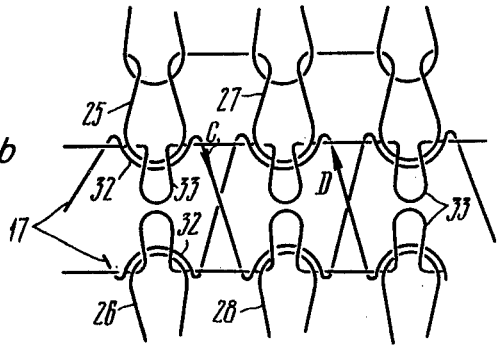

After the welt, leg, heel, sole, and toe of the stocking have been knit, the linking thread 17 is laid in the aforesaid manner in the form of tuck stitches 32 (FIG. 6*a*,) in selected needles of the cylinder which are alternately operated on the opposite sides of the cylinder. Thereupon locking courses conventionally shown as one course of loops 33 are knit on all the needles of the cylinder, with the linking thread 17 being then pulled out to bring together the opposite-lying loops of the linking course until their complete butt-closure is aligned, thus forming a linear seam. With regard to the pulling of the linking thread during the formation of tuck stitches, it will be understood that since the linking thread constitutes itself a tuck loop and pressed by the loops formed of a knitting thread (loops 26, 28, 33), the linking thread can be readily pulled out from the article. The linking thread 17 in the seam zigzags, while the linked loops 25–28 are staggered (FIG. 6*a*). When one linking thread 17 or two threads 17 are laid in the forward and reverse directions, the linked loops 25–28 are disposed in the seam one opposite the other (FIG. 6*b*).

The toe of the stocking can be worked by the conventional method as a double mesh with the second toe layer being sewn on and the locking courses being knit after the toe is sewn up on all the needles of the cylinder. The linking thread is pulled out as the second toe layer is being knit.

In connection with FIGS. 3 and 4, it should be pointed out that any number of loops may be linked provided the same does not exceed half of the loops of the article. Regarding the manner of fixing the end of the linking thread which has served for pulling it out, it should be stated that this thread is drawn inside the loops of the knitted article and may be, for instance, welded after it has been pulled-out.

With regard to the pulling of two threads, in the case of laying two threads 17, there are used two devices for laying and pulling. The laying is achieved with alternate actions of the laying devices and pulling is always accomplished on a closed cylinder.

What we claimed is:

1. A tubular knit article knit with a closed end on a circular knitting machine, comprising a linking course of opposite-lying loops positioned on a plurality of opposite circumferential portions which define the tubular end to be closed; a linking thread passing through said opposite-lying loops in a zigzag manner such that subsequent to passing through a loop on one circumferential portion it passes through another loop on an opposite circumferential portion before it again passes through the loop adjacent to the loop on said one circumferential portion so that the opposite-lying loops in the linking course are drawn together until their complete butt closing is aligned, thus forming a linear seam.

2. The tubular article as in claim 1, wherein the opposite-lying loops of the linking course are staggered in the linear seam.

3. The tubular article as in claim 2, wherein used as the linking thread is a high-elasticity rubber-like yarn which stretches along a straight line in the linear seam.

4. The tubular article as in claim 2, wherein the linking thread is the knitting yarn of the article.

* * * * *